US005820065A

United States Patent [19]

Altosaar et al.

[11] Patent Number: 5,820,065

[45] Date of Patent: Oct. 13, 1998

[54] APPARATUS AND METHOD FOR REELING A WEB

[76] Inventors: Erik Altosaar, 162 Grandview Avenue, Thornhill, Ontario, Canada, L3T 1J1; Angelo Stephen De Bono, 3514 Pinesmoke Crescent, Mississauga, Ontario, Canada, L4Y 3L3; Kenneth Stephen Klempner, R.R. #4, Tottenham, Ontario, Canada, L0G 1W0

[21] Appl. No.: 796,521

[22] Filed: Feb. 6, 1997

[51] Int. Cl.[6] ..... B65H 18/08

[52] U.S. Cl. ..... 242/534; 242/541.7

[58] Field of Search ..... 242/533, 533.2, 242/534, 534.2, 541, 541.4, 541.7

[56] References Cited

U.S. PATENT DOCUMENTS

| | | | |
|---|---|---|---|
| 3,845,320 | 10/1974 | Winberg | 250/571 |
| 3,857,525 | 12/1974 | Gerber et al. . | |
| 3,883,086 | 5/1975 | Zangenfeind et al. . | |
| 3,898,436 | 8/1975 | Pottebaum et al. | 242/534.2 |
| 4,052,599 | 10/1977 | Whiteley et al. | 242/534.2 |
| 4,267,752 | 5/1981 | Byrt et al. | 83/74 |
| 4,445,646 | 5/1984 | Karr et al. . | |
| 4,535,949 | 8/1985 | Olsson | 242/534.2 |
| 4,634,068 | 1/1987 | Malkki et al. | 242/541.7 |
| 4,770,361 | 9/1988 | Maeda . | |
| 4,794,475 | 12/1988 | Kosugi et al. | 260/90 |
| 4,856,692 | 8/1989 | Harper | 226/119 |
| 4,883,233 | 11/1989 | Saukkonen et al. . | |
| 4,921,183 | 5/1990 | Saukkonen et al. . | |
| 5,110,062 | 5/1992 | Kremar . | |
| 5,131,592 | 7/1992 | Shibata et al. | 242/534 |
| 5,154,367 | 10/1992 | Beisswanger | 242/541.4 |
| 5,192,034 | 3/1993 | Beisswanger | 242/541.7 |
| 5,249,758 | 10/1993 | Muller et al. | 242/534.2 |
| 5,360,179 | 11/1994 | Vesterinen et al. | 242/526.3 |
| 5,370,327 | 12/1994 | Adamski | 242/533.1 |
| 5,441,211 | 8/1995 | Ueda et al. | 242/526.1 |
| 5,467,194 | 11/1995 | Pellinen et al. | 356/429 |

FOREIGN PATENT DOCUMENTS

| | | | |
|---|---|---|---|
| 2046605 | 3/1989 | Canada | B65H 19/20 |

*Primary Examiner*—John P. Darling
*Attorney, Agent, or Firm*—Rogers & Scott

[57] ABSTRACT

The turn-up of a continuous web from a parent reel to a new spool is made using an apparatus for sensing the presence of the newly cut web about the new spool and moving the new spool about a pope reel drum once the web has begun to wind on the new spool. A signal processing system is provided to monitor the speed of the web, defects in the web, the position of primary and secondary arms, and whether a turn-up has failed. The system provides output signals to control the timing of the turn-up and the motion of the primary and secondary arms. The apparatus may have several sensors for measuring the presence of the web, the speed and elapsed number of turns of the spool, and may have different types of sensors for use with different types of spool materials.

6 Claims, 7 Drawing Sheets

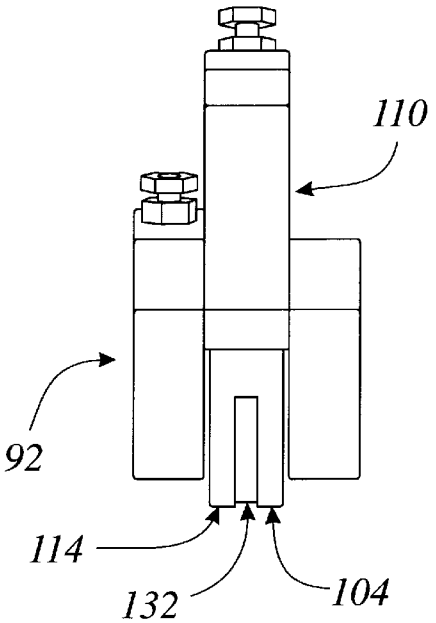
Figure 2b.
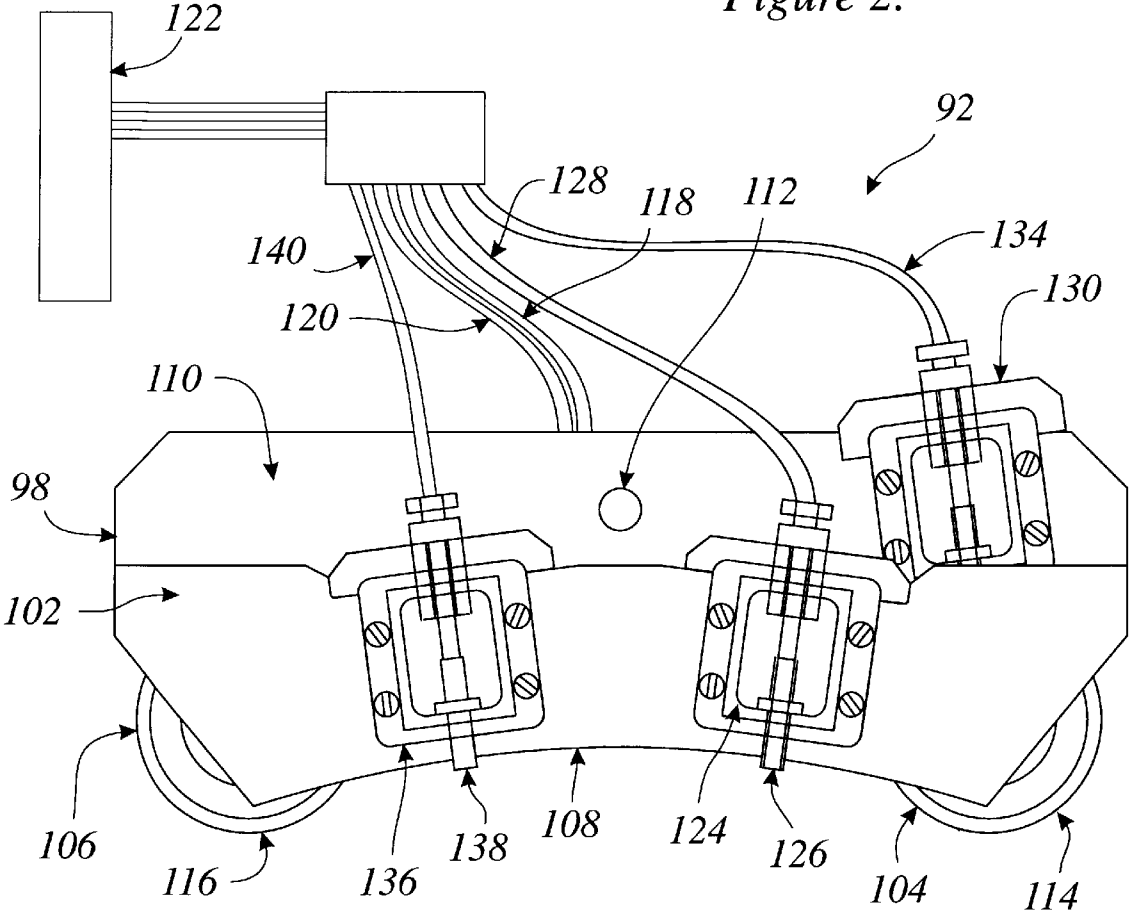
Figure 2.
Figure 2a.

APPARATUS AND METHOD FOR REELING A WEB

FIELD OF THE INVENTION

This invention relates generally to devices for reeling a web onto a cylinder, and more particularly for detecting the presence of a web about a cylinder for determining timing and motion of reeling equipment. Most specifically, the invention concerns the process of terminating accumulation of a web on a first spool, and commencing accumulation of a web on a second spool while the web continues to be delivered to the reel forming apparatus at a constant rate, and a device for detecting when the web has engaged the second spool.

BACKGROUND OF THE INVENTION

A recurrent problem in the paper making industry, and other industries having similar processes, has concerned the reeling of paper onto spools as the paper leaves the paper making machine. As it is difficult and expensive to stop the paper making machine merely to change a take up spool, a system is required to terminate the accumulation of paper on one spool and to commence accumulation on another spool while newly made paper continues to be delivered from the paper making machine at a relatively constant speed. This process of cutting and transferring a web to a new reel is called a turn-up.

Once a web has been cut, the cut end is not necessarily prone to feed onto the new spool without wrinkles. The wrinkled portion of the web collected on the spool is generally unusable, and so becomes waste. One way to reduce the amount of wrinkling is to bend the web about a drum and to move the new reel away from the twelve o'clock position as quickly as possible.

Since the web of paper will continue to stream out of the paper machine at high speed it is important to determine as quickly as possible whether the web has failed to engage the new spool properly. If so, the new spool must be moved out of the way as quickly as possible and another effort at starting a new spool must be made.

It is also advantageous in the operation of paper reeling machinery to make sure that a spool moved about a drum to a better position for reeling without wrinkles will find appropriate machinery waiting to receive it.

At present an operator watches to determine when each spool is full, that is, when it has reached a specific diameter, when to lower the next spool against the top of the drum, and when enough of the web has collected on the new spool that it can safely be moved about the drum. Notwithstanding experience, an operator's eye is a relatively imprecise measuring instrument, and the timing and accuracy of the operation varies from operator to operator. It would be preferable to have a device and method for ascertaining when the web has engaged the spool sufficiently, and for controlling the movement of the various elements of the process.

It is not uncommon for patches of unusable web to be delivered to the output reel. An operator may, again, have difficulty estimating the amount by which the diameter of a parent reel should be increased to allow for defective portions of the web, since too little allowance will yield insufficient good web to yield the amount desired, and too great an allowance will yield a wasteful amount beyond the amount of good web desired on the reel.

There is therefore a need for an improved system for controlling the turn-up of a continuous web onto a spool.

DISCLOSURE 0F THE INVENTION

The present invention relates to a means for determining whether a web is present about a spool. In a first aspect of the invention there is an apparatus for sensing the presence of a web about a spool, that apparatus comprising a structural member for mounting to a support structure for deployment of the apparatus adjacent the spool; a sensing means mounted to the structural member having sensing means alterable from a first output state when sensing a bare spool to a second output state when sensing a web on the spool; and means for communicating the output states to a signal processing device.

In a further aspect of the invention, the apparatus includes distance measuring means for measuring the circumferential distance turned by the spool. In still another aspect of the invention the sensing means is of a type chosen from at least one of the group consisting of: a) an electrical resistance measurement circuit; b) a proximity sensor; c) a photoelectric sensor; and d) a digital camera. In still yet another aspect of the invention the apparatus has first and second followers mounted to the structural member for riding upon the surface of one of (a) the spool; and (b) a web covering the spool.

In another aspect of the invention there is a system for controlling the turn-up of a paper reeling machine, that paper reeling machine having a) a drum against which to turn a continuous moving web; b) first means for urging a first reeling spool toward the drum to squeeze the web therebetween; c) second means for moving the spool about the drum from a first position to a second position; d) third means for receiving the spool from the second means and for retaining the spool during reeling of the web thereupon; and e) fourth means for cutting the web upstream of a spool in said first position, and for encouraging the leading edge of the cut web to wind about the spool; that system having a structural member for mounting to a support structure adjacent to the spool; a sensing means mounted to the structural member having sensing means alterable from a first output state when sensing a bare spool to a second output state when sensing a web on the spool; and means for communicating the output states to a signal processing device.

A still further aspect of the invention includes a method of controlling the turn-up of a continuous web onto a spool, that method comprising the steps of: positioning a new spool above a continuously moving web at a location where that web is being bent about a partial arc of a drum; positioning an apparatus for sensing the presence of a web about a spool in a position for sensing the presence of a web about the spool, that apparatus having a sensing means alterable from a first output state when sensing a bare spool to a second output state when sensing a web on the spool; and means for communicating said output states to a signal processing device; cutting the web and causing the leading edge of the cut web to wrap around the spool; sensing with said apparatus for the presence of web about the spool monitoring the output states of the sensing means with the signal processing device; and moving the spool about the drum on interpretation by the processing device that the web is present about the spool.

BRIEF DESCRIPTION OF DRAWINGS

FIG. 2, being FIGS. 2*a* and 2*b*, shows side and front views of an apparatus for sensing the presence of a web about a spool for use in the web reeling apparatus of FIG. 1.

FIG. 4, being

BEST MODES FOR CARRYING OUT THE INVENTION

Figure 1:
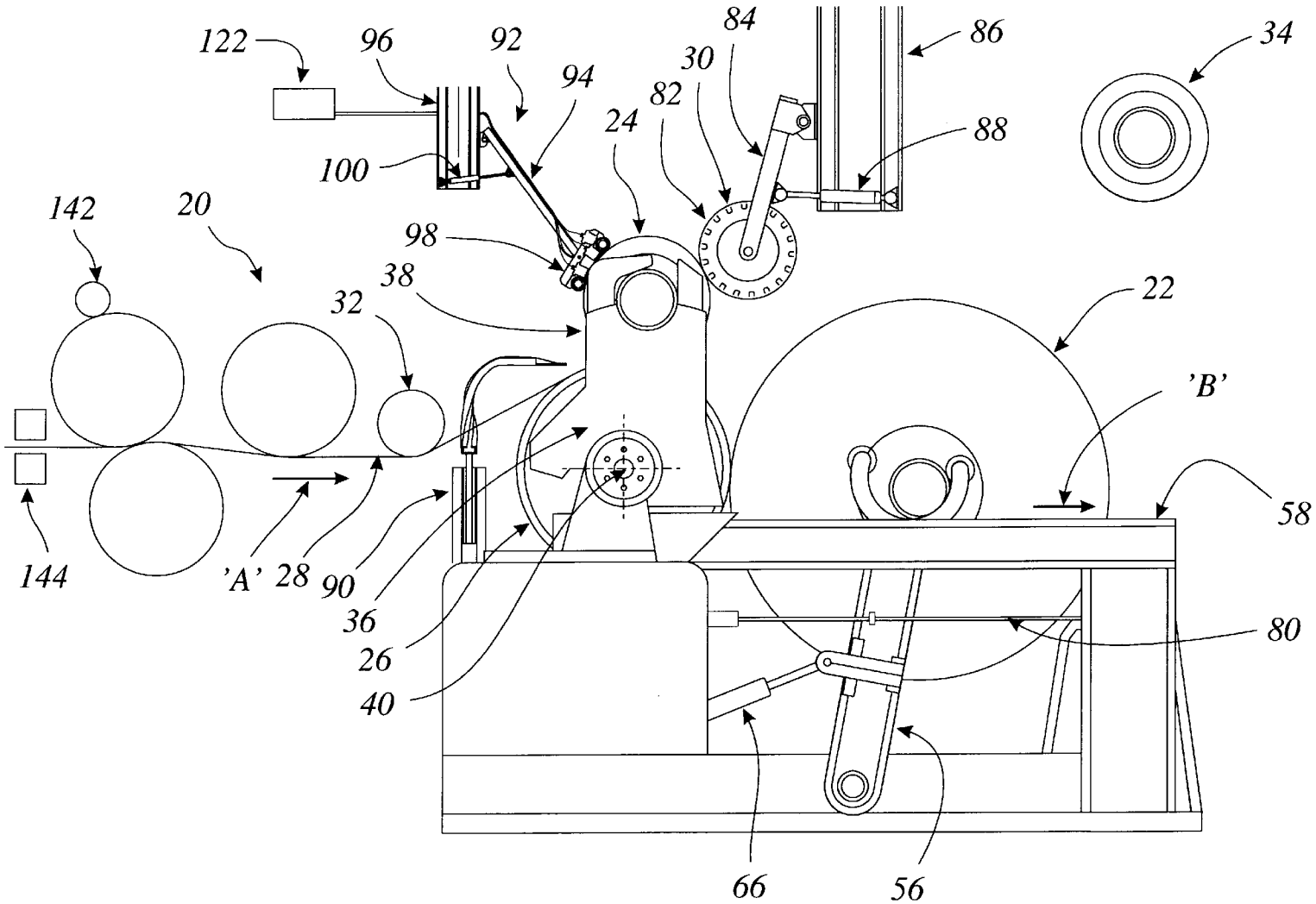
FIG. 1 shows a general arrangement side view of an embodiment of web reeling machinery according to the present invention.

In the description which follows, like parts are marked throughout the specification and the drawings with the same respective reference numerals. The drawings are not necessarily to scale and in some instances proportions may have been exaggerated in order more clearly to depict certain features of the invention.

The output end of a paper machine is shown generally in FIG. 1 as 20. A nearly full spool, or parent reel, is indicated as 22, a waiting empty spool is illustrated as 24, and a driven drum is indicated as 26. A continuous web 28 leaves paper machine 20 at a constant speed, several hundreds of feet per minute, in the direction of arrow 'A'. Initially empty spool 24 waits clear of web 28. Most commonly, spools such as item 24 are 20 inch diameter steel cylinders weighing roughly 1800 lb., having a central shaft extending axially from both ends thereof, each shaft end having a bearing mounted thereto suitable to be grasped by a spool holding device such that the bearing is held and the cylinder is free to revolve about the axis of the shaft. Spools need not always be made of steel, and may have, for example, a rubber or other elastomeric surface in some cases. A spool starter drive apparatus, shown generally as 30, is used to cause spool 24 to spin at a speed approximating the speed at which web 28 is moving. Once the previous, or parent reel, has reached the calculated desired reel size, measured by length of web ( SPEC LENGTH) or reel diameter (SPEC DIAMETER), spool 24 is lowered to contact web 28, in what, although not precisely vertical, may for convenience nonetheless be termed the twelve o'clock position, or $\alpha_{12}$. Very soon thereafter web 28 is cut by any of several known means, between the last roll, a paper spreading roll 32 of paper machine 20 and drum 26. That portion of web 28 downstream of the cut runs along drum 26 to collect on full spool 22, which is then moved away for subsequent processing or use. That portion of web 28 upstream from the cut begins to wind onto spool 24, encouraged by any one of several known means. Once spool 24 has begun to accumulate web 28, it becomes the new parent rcel, and is rotated about drum 26 to the position formerly occupied by spool 22, which, although not precisely horizontal, may for convenience nonetheless be referred to as the three o'clock position, or $\alpha_3$, and a new spool 34 is brought into position, ready to recommence the cycle when spool 24 has been filled.

Figure 3A:
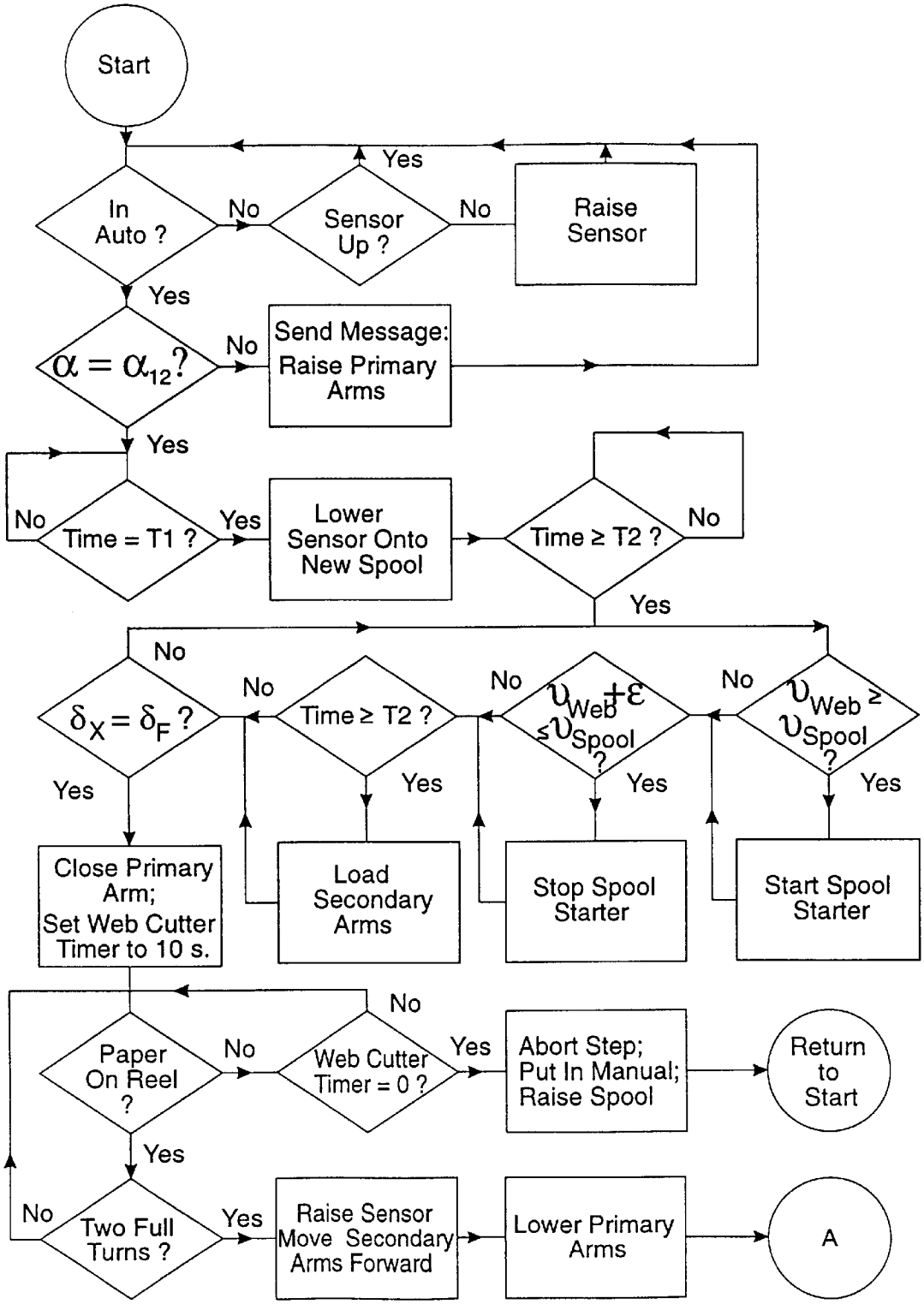
FIG. 3, having first and second sheets, shows an algorithm for operating the web reeling machine of FIG. 1 with the apparatus shown in FIG. 2.
Figure 3B:
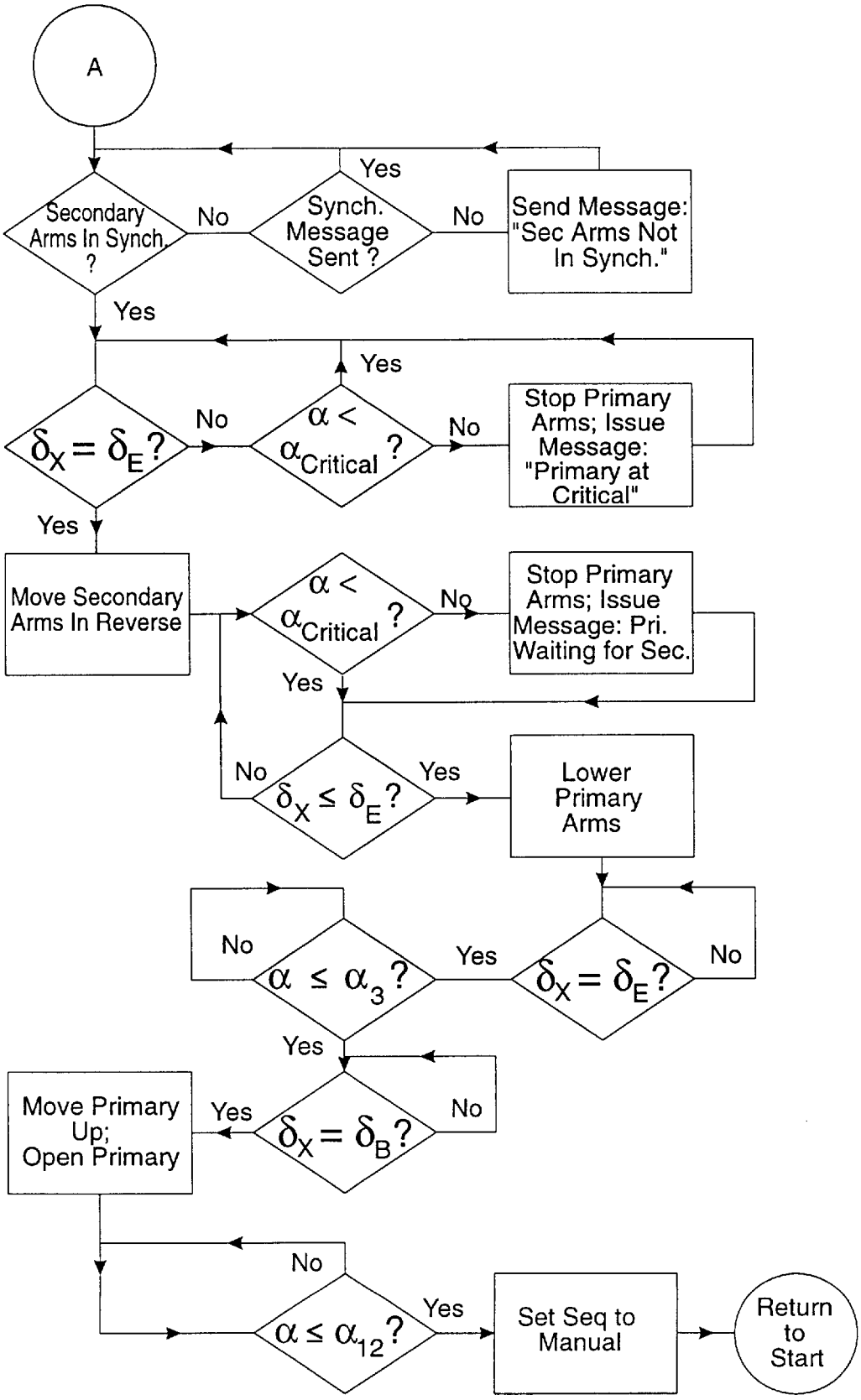

The embodiment illustrated in FIG. 1 will now be described in greater detail with reference also to FIGS. 2, 3, and 4. A spool holding apparatus in the nature of a pope reel is shown generally as 36. It includes drum 26, and a pair of primary arms 38, one of the pair being the visible side illustrated, the other, not visible in the illustrations, being a matching arm of opposite hand at the far end of drum 26, which pivot about an axis of rotation 40 common to drum 26, and, as shown in FIG. 4*f*, a driven gear 42. As shown in FIG. 4*a*, primary arms 38 have an arcuate seat 44 for receiving the bearing surface of a spool, be it 24, 34 or some other. As shown in FIG. 4*a*, seat 44 is disposed between a grasping mechanism in the form of a slidingly retractable tongue 46, the sliding direction being vertical in FIG. 4*a*, and a co-operable opposed claw 48 pivotally movable about a pivot 50 from an open position in which a new spool may be introduced into seat 44; and a closed position in which a finger 52 urges a spool, such as spool 24, to remain within the grasp of primary arms 38. The movement of claw 48 to the open position described also causes a movable stop 54 to move about pivot 50 to a position in which a spool located between tongue 46 and claw 48 at $\alpha_{12}$ is compelled to sit clear of web 28 and drum 26. A clearance of ⅜ inches has been found satisfactory.

Primary arms 38 are movable about axis 40 from a first position for receiving a spool, at $\alpha_{12}$, to a second position, or $\alpha_3$ for delivering that spool to a pair of secondary arms 56 which co-operate with a pair of ways 58 along which a filled roll is removed, as will be described below. As with primary arms 38, only one of secondary arms 56 is shown, the other being of opposite hand and not visible in the illustrations. The motion of primary arms 38 about axis 40 is controlled by an electric motor and gear drive system of conventional construction not visible in the illustrations. The sliding motion of tongue 46 and the pivoting motion of claw 48 are driven by pneumatic cylinders of conventional construction and operation, also not visible in the illustrations. A feature of such a pneumatic system during movement from $\alpha_{12}$ to $\alpha_3$ that as web 28 accumulates about spool 24 pneumatic pressure, acting through the medium of finger 52 of claw 48, constantly urges spool 24 toward drum 26. Also, as the number of layers of web 28 about spool 24 increases, that increase in diameter of the reel forces spool 24 outwardly from seat 44. This motion compels finger 52 to deflect incrementally counter-clockwise about pivot 50. Despite this deflection, pneumatic pressure continues to act through finger 52 to urge against spool 24 against drum 26.

Figure 4B:
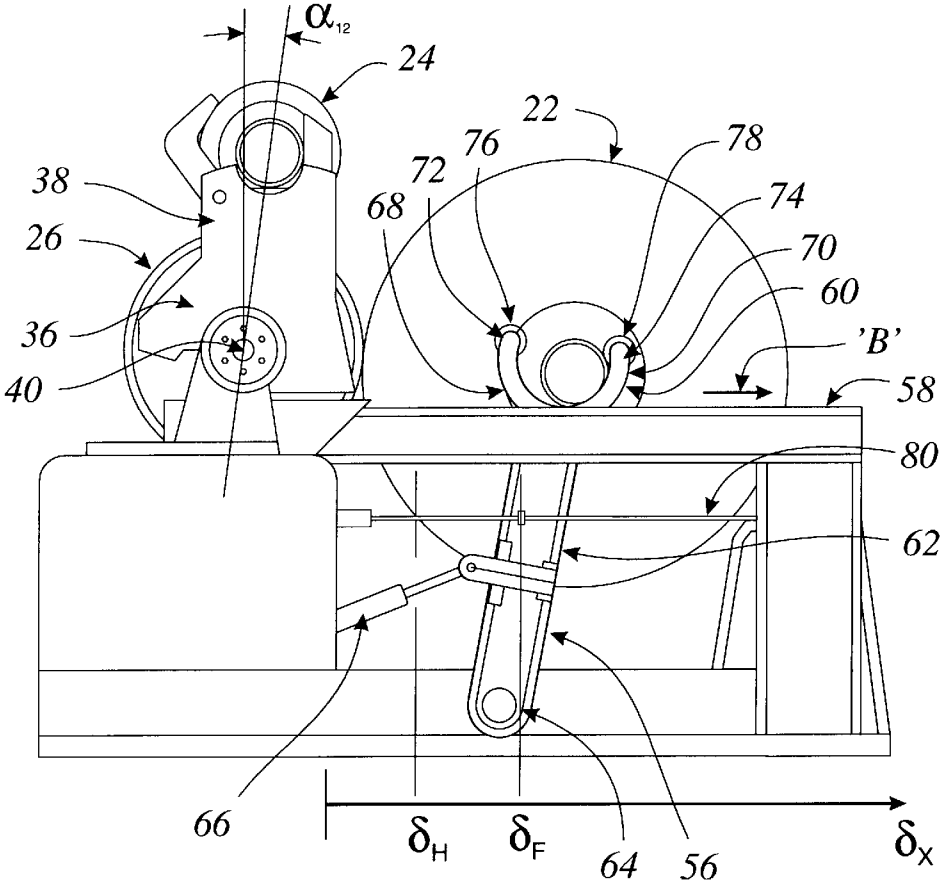
FIGS. 4*a*, 4*b*, 4*c*, 4*d*, 4*e* and 4*f* shows a series of views according to the cyclic operation of the machine of FIG. 1 according to the algorithm of FIG. 3.
Figure 4A:
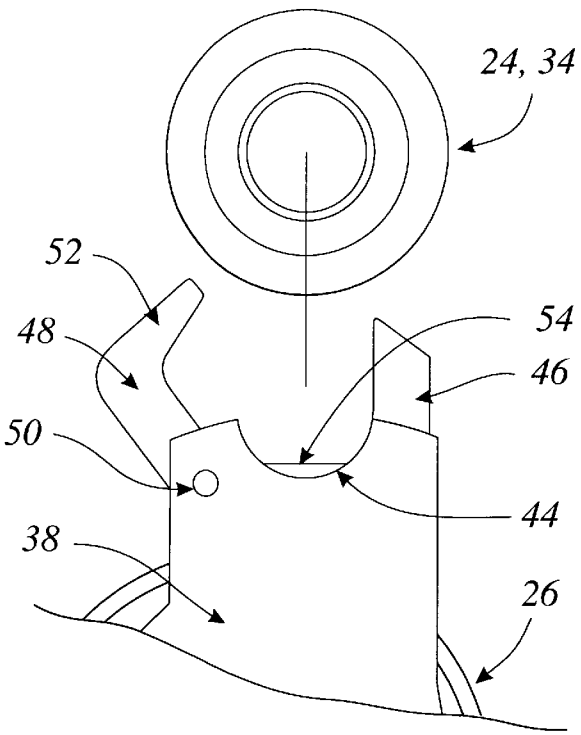

As indicated in FIG. 4*b* et seq., secondary arms 56 each have the form of a yoke 60 mounted on a shaft 62 extending radially outward from an axle 64 about which secondary arms 56 may pivot. A double acting pneumatic cylinder 66 is used to urge secondary arms 56 forward, or clockwise, about axle 64 to an extended position, and backward, or counter-clockwise, thereabout to a home, or return, position. Cylinder 66 is connected to a pressurized air supply and valve system permitting supply of 90 p.s.i.g. in the forward directions, and 30 or 90 p.s.i.g. in the rearward direction. Each leg 68 or 70 of yoke 60 terminates in a toe 72 or 74 respectively, each having a roller 76 or 78 mounted thereto. Yoke 60 is of a radius of curvature to allow generous entry of spool 24 therein between rollers 76 and 78, and of such a size that the weight of each full parent reel is carried by ways 58.

In operation, secondary arms 56 are positioned in the first, or home position, to receive a spool, such as spool 24 as it moves to $\alpha_3$ in the grasp of primary arms 38. The thickness of web 28 collected on spool 24 as it arrives at $\alpha_3$ is not, in general, constant from spool to spool, but varies according to the thickness of stock produced by paper machine 20, and the number of turns accumulated before reaching $\alpha_3$. Yoke 60 accommodates this variation. As web 28 builds about spool 24, finger 52 deflects, and eventually spool 24 engages roller 78. At this point backward pressure in cylinder 66 works to urge spool 24 against drum 26 and claw 48 can be released and returned to its open position. Similarly, tongue 46 may be retracted to facilitate return of primary arms 38 to $\alpha_{12}$ to await a succeeding spool.

The position of secondary arms 56 may be measured in many ways, whether by angular position about axle 64 or by linear measurement on ways 58. In the embodiment illustrated the position of secondary arms 56 is determined by linear measurement using a Magnerule Plus (T.M.) a magnetic induction sensitive position sensor indicated as 80. A discrete measuring system, or a system of mechanical stops and relays could also be used, as could other forms of continuous distance measurement.

Spool starter drive apparatus 30, includes a motor of conventional nature, not visible in the illustrations, connected to driven wheel 82 mounted at the depending extremity of an arm 84, itself pivotally mounted to a support structure 86. Double acting pneumatic cylinder 88 extends from structure 86 to arm 84 such that provision of pressurized air to one side or the other of cylinder 88 will bias driven wheel 82 against or away from spool 24. A motor control (not shown) is used to adjust the speed of the moter, and hence driven wheel 82 to cause a spool to evolve at a rate for matching the linear speed of web 28.

A web cutting device is indicated as 90. In the illustrated embodiment this device is a Sandar Industries Inc., TUSA IV (T.M.) web cutter using a cutting tape in the manner set forth in laid open Canadian Patent Application 2,046,605. Other web cutters are known in the art.

Finally, an apparatus for sensing the presence of the web about the new reel is indicated generally as 92. In the embodiment illustrated it includes an arm 94 movably extending from a support 96, and a sensor carriage 98 loosely mounted to the distal end of arm 94. As before, a pneumatic cylinder 100 is provided to urge carriage 98 against or away from spool 24 as may be desired. Apparatus 92 is shown in FIG. 1 contacting spool 24 on a slant, for ease of illustration. In the preferred embodiment it swings downwardly and outwardly from support 96 to ride on top of spool 24 at roughly the 12 o'clock position.

Carriage 98 is shown most fully in FIGS. 2*a* and 2*b*. Carriage 98 includes a frame or body 102 to which are mounted a leading spool follower in the nature of a steel roller bearing indicated as a first roller 104 and a trailing spool follower in the nature of another steel roller bearing indicated as second roller 106. Body 102 has a relieved arcuate face 108, the better to accommodate the curvature of a spool, such as spool 24, and an outwardly extending dorsal member, or spine 110 having a through hole 112 located more or less centrally therein to permit attachment to arm 94. Rollers 104 and 106 are mounted within body 102 such that their rolling surfaces 114 and 116 stand proud of arcuate face 108 for contacting a spool, and are each in electrical contact with a lead wire, 118 or 120 respectively, in turn suitable for connection to an electrical resistance sensing device and signal processing apparatus of a conventional nature, indicated schematically as 122. When placed in contact with a bare steel spool the electrical resistance registered between rollers 104 and 106 will be negligible. However, when a web of paper or other less conductive material is present electrical resistance therebetween will be significantly increased. It will be appreciated that other devices, such as brushes or sliding electrical contact shoes or similar devices could be substituted for rollers 104 and 106 without altering this function.

In the version of TUSA IV (T.M.) web cutter employed, the tear begins at one side and works in a spiral to the other side. In another type of web cutter a tear is initiated near the centre line of web 28 which eventually works its way on a curve to the outer edges of the web. In either case apparatus 92 is preferably placed at a location near the edge of web 28 where the last part of the tear will occur. thus it will also be at the last location at which the new web will begin to turn up.

It may be noted that a non-contacting sensor, such as a suitably positioned, rigidly mounted digital camera capable of differentiating between a bare metal, or bare rubber, surface and a paper or textile web surface may also be suitable for the present purposes, and could be augmented by optical timing marks or other similar means for determining the cumulative angular displacement of spool 24. Such a camera need not ride on spool 24 but could be positioned in fixed spaced relationship therefrom at a desired orientation and distance for observing spool 24 while not obstructing the spool changing process.

A second device for sensing the presence of a web, in the nature of a proximity sensor is shown as 124, mounted within body 102 and having a probe 126 extending therefrom proud of arcuate face 108 for suspension in close proximity to the surface of a spool when rollers 104 and 106 are riding thereupon. It will be noted that sensor 124 whether it is a reluctance or capacitance or similarly based electrical properties sensor, is sensitive to the distance of separation between probe 126 and the more or less monolithic steel structure of spool 24 and the reading obtained therefrom will vary significantly as each successive layer of web 28 is introduced therebetween. In the prefered embodiment a reluctance sensor is used. As above, the output signal from sensor 124 is communicated by wire 128 to signal processing device 122.

A third sensing device in the nature of a counter is shown as 130. Roller 104 is provided with a partial rebate or groove 132 extending through a partial arc of the circumference, that partial arc being 180 degrees. Each revolution of roller 104 will generate an alternating signal in counter 130, communicated via wire 134 to signal processing device 122, such that the distance traveled along a contact surface may be computed, the rate of alternation also providing a measure of the speed spool 24, and subsequently of web 28.

A fourth sensor in the nature of an optical sensor 136 is shown mounted to body 102 and has an objective 138 extending proud of face 108 for observing spool 24. An output signal is communicated to signal processing device 122 by means of wire 140.

Also shown in FIG. 1 are a reel calendar web speed measuring device 142 and a web OFF SPEC defect indicating device 144, each providing an output signal to signal processing device 122.

The operational sequence for achieving a web turn-up onto a new spool will now be described with reference to the sequence of illustrations of FIGS. 4*b* through 4*f*, following the logical sequence set out in FIG. 3. In FIG. 4*b* parent reel 22 is nearing its full size. New spool 24 has just been lowered into primary arms 38 at the twelve o'clock position and claw 48 is in its open position such that spool 24 is held on stop 54, clear of web 28 and drum 26. Spool 24 is not revolving. Apparatus 92 and driven wheel 82 are both held clear of spool 24. Cylinder 66 is provided with sufficient pressure to urge secondary arms 56 in the backward direction, in a position in which the signal from position locating device 80 to signal processing device 122 is interpreted as $\delta_X$. An operator has selected automatic operation, or AUTO mode.

Signal processing device 122 continuously monitors $\delta_X$ to compare it with a set point turn-up value $\delta_F$(i.e., parent reel full). $\delta^F$ is not necessarily a constant value, but is calculated for each successive reel on the basis of a desired quantity of good web plus an adjustment for any amount of web containing defects detected by OFF SPEC defect indicating device 144 at the web speed $v_W$ indicated by web speed measuring device 142. A value for either ON SPEC LENGTH or ON SPEC DIAMETER parameters is calculated, and updated at real time, whence a current value for $\delta_F$ is determined according to the specific geometry of the machine.

At a time T1, $(\delta_F-\delta_X)/v_W$ equals a preset value of X1 seconds for the time remaining before a turn-up is due. At time T1 apparatus 92 and driven wheel 82 are brought into engagement with spool 24. At time T2, similarly determined, signal processing device 122 provides a signal to bring driven wheel 82 into engagement with spool 24 and, while monitoring the output from counter 130, provides an ON/OFF output signal to the motor of spool starter apparatus 30 to cause driven wheel 82 to drive spool 24 at a circumferential speed between $v_W$ and $v_W$ plus a preselected dead-band value, $\epsilon$, by a time X2 seconds before a turn-up is due. At time T3, X3 seconds before a turn-up is due, the pressure in cylinder 66 is reduced to LOADING pressure, a reduced pressure, such as 30 p.s.i.g., in the backward direction. This is the state illustrated in FIG. 4*b*.

At time T4 the turn-up is initiated as driven wheel 82 is disengaged from spool 24, claw 48 is moved to its closed position thus lowering stop 52 and permitting spool 24 to engage drum 26 at $\delta_F=\delta_X$. After a 750 ms wait the web cutting device is energized, in the specific embodiment illustrated the TUSA IV (T.M.) cutter advances the sticky end of its tape into the nip between spool 24 and drum 26. As soon as the tape is pinched between web 28 and spool 24 it begins to wind in a spiral thereabout, cutting web 28 as it does so, and compelling that portion of web 28 upstream from the cut location also to wrap around spool 24. The remainder of web 28 downstream from the cut location continues along drum 26 to accumulated on parent reel 22.

Signal processing device 122 monitors the resistance between rollers 104 and 106 and the proximity of sensor 124, and the photoelectric output of sensor 136, to determine whether there has been a change in electrical conductivity or a change in proximity or detection which would indicate the presence of web 28 about spool 24. From the time that such a signal is received processing device 122 monitors the signal from counter 130 while continuing to test for the presence of web 28. In the preferred embodiment the test for a successful turn-up is whether web 28 is present after two full revolutions of spool 24. Not all of the sensors need be provided, but additional sensors permit more versatile use of a single apparatus for more than one type of spool, and may also provide a measure of verification for each other.

If the test for the presence of web 28 fails after two full revolutions then signal processing device 122 provides a signal to cause claw 48 to return to the open position, in which stop 54 once again raises spool 24 clear of drum 26, causes a warning signal to alert an operator, and terminates automatic operation by transferring the entire system to manual control.

If the test is successful, then signal processing device 122 initiates operation of the primary arm motor to cause the primary arms 38 to leave the twelve o'clock position and move toward the three o'clock position. It is advantageous to do this at an early opportunity since forcing web 28 to traverse a greater distance along an arc of drum 26 before winding on spool 24 will tend to discourage, if not rapidly eliminate, wrinkling. During this movement pneumatic pressure acting through finger 52 urges spool 24 toward drum 26, encouraging formation of a taut reel. Once a successful turn-up has been achieved apparatus 98 is also withdrawn to an inactive position.

As primary arms 38 rotate about axis 40 carrying spool 24 they soon approach a critical angle, $\alpha_{Critical}$ which defines the angle beyond which the motor driving the motion of primary arms 38 is incapable of stopping and returning spool 24 to the twelve o'clock position. Before primary arms 38 move past $\alpha_{Critical}$ and complete the motion to $\alpha_3$ it is necessary to determine whether secondary arms 56 will be in an appropriate position for receiving the new reel, spool 24, when it arrives. A number of steps must have occurred to satisfy that condition.

When web 28 is cut at $\delta_X=\delta_F$ a the reduced, loading pressure, such as 30 p.s.i.g., is released from the backward direction of cylinder 66 and an high ejecting pressure, such as 90 p.s.i.g. in the forward direction is applied to urge secondary arms 56 to move in a clockwise direction, that is, away from pope drum 26. This pressure will force parent reel 22 outwardly in the direction of arrow 'B' along ways 58 to a position from which it may be moved elsewhere for further processing. During this motion signal processing device 122 monitors the Magnerule Plus (T.M.) output to ensure that both arms of secondary arms 56 move synchronously, it being advantageous to avoid ejecting a full reel, weighing perhaps 15 tons, at a skewed angle.

Figure 4C:
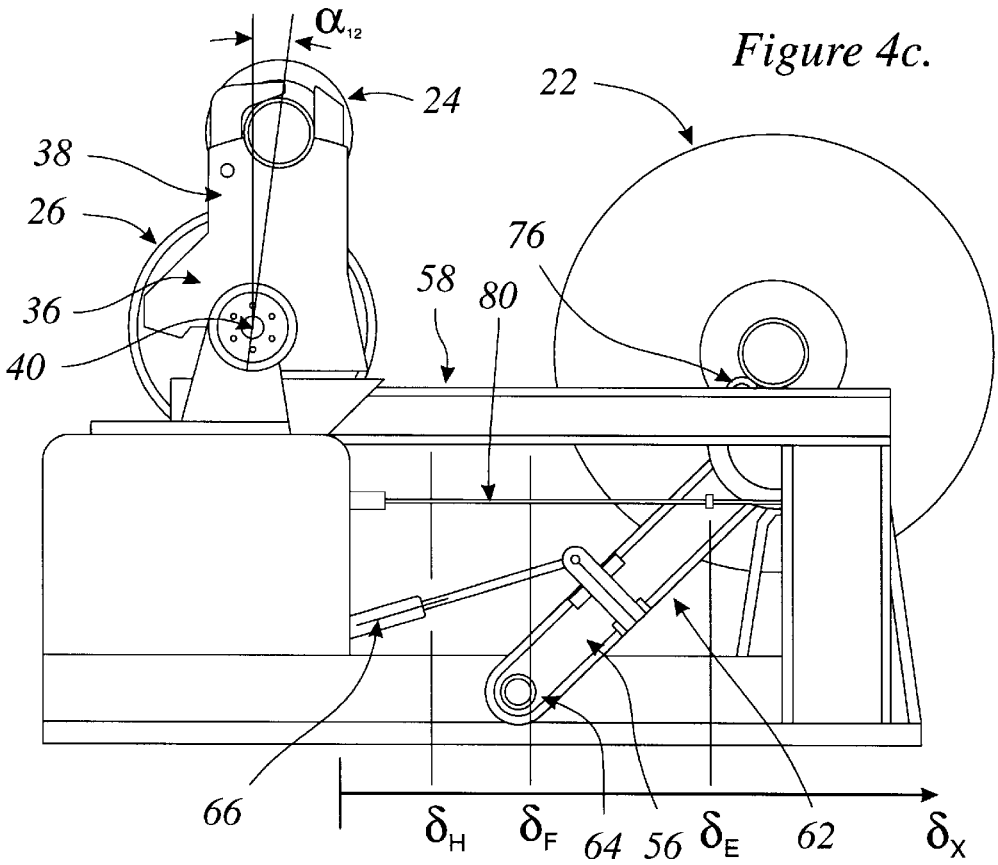
Figure 4D:
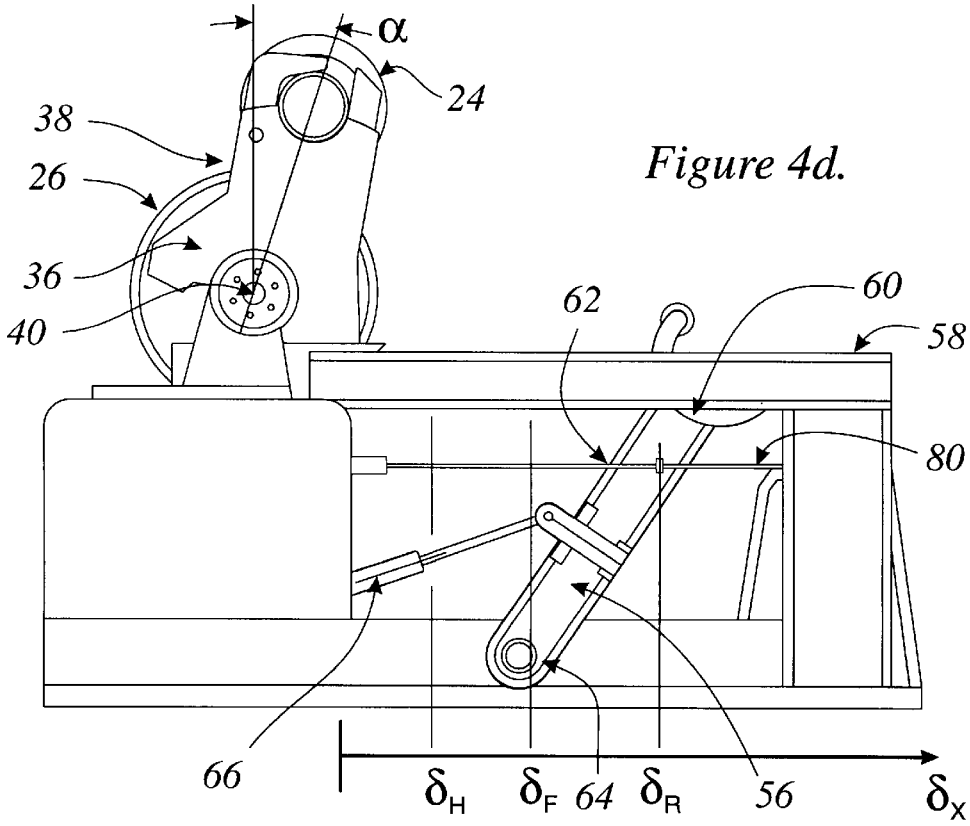
Figure 4E:
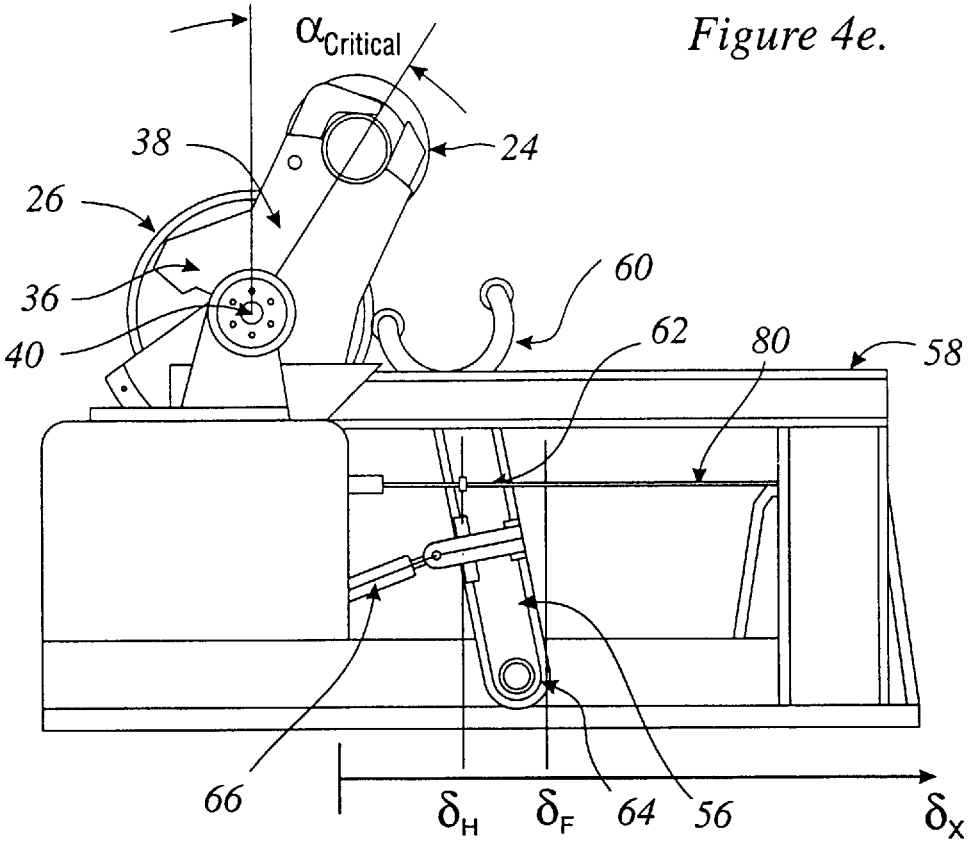
Figure 4F:
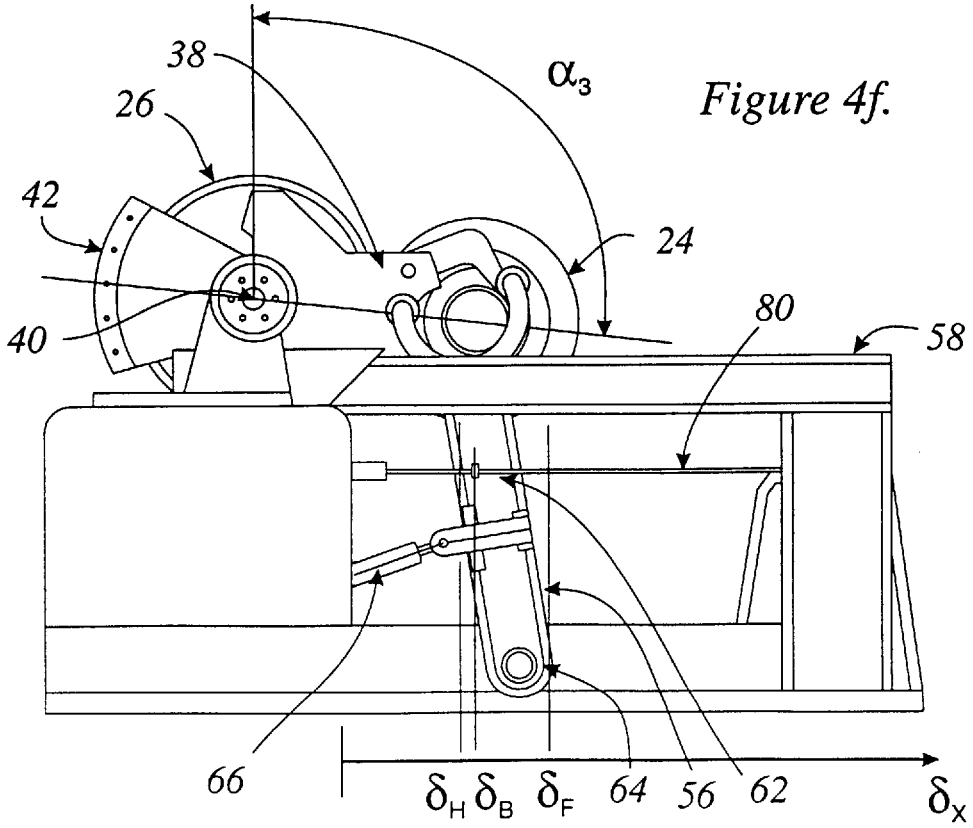

FIG. 4*c* shows uppermost roller 76 at the point at which it no can longer exert a force against parent reel 22. Roller 78 is shy of the uppermost surface of ways 58. and cannot impede the ejection of parent reel 22 which is thus released from yoke 60. In this position measuring sensor 80 indicates $\delta_E$, that is, full extension of secondary arms 56. Parent reel 22 has enough momentum to continue rolling along ways 58 to reach a stop.

When signal processing device 120 finds that $\delta_X=\delta_E$, it produces an output signal to vent the pressure from the forward side of cylinder 66 and to apply high pressure, such as 90 p.s.i.g, to the rearward side of cylinder 66 to cause secondary arms 56 to return toward drum 26.

Having done this processing device 122 continues to monitor the output signal from measuring sensor 80 and to test it against $\delta_R$, that is, a chosen location along ways 58 closer to drum 26 than $\delta_E$. When $\delta_X=\delta_R$one may infer that secondary arms are returning toward $\delta_H$, a home, or return position close to drum 26, and it is permissible to allow primary arms 38 to pass $\alpha_{Critical}$ since it may also be inferred that the time required for the secondary arms 56 to travel from $\delta_R$ to $\delta_H$ is less than the time for primary arms 38 to move from $\alpha_{Critical}$ to $\alpha_3$.

When $\delta_X=\delta_H$ $\alpha=\alpha_3$, that is, when spool 24 enters yoke 60 and encounters ways 58, signal processing device 122 causes the primary arm motor to stop. Web 28 continues to build on spool 24, causing it further to deflect finger 52. In due course spool 24 also begins to cause motion of secondary arms 56 clockwise about axle 64. When $\delta_X=\delta_A$ the force required to maintain spool 24 against drum 26 is provided by cylinder 66 and the pneumatic force on finger 52 may be released. Thus signal processing device 122 causes claw 48 to move to its open position, releasing spool 24. To facilitate early return of primary arms 38 to $\alpha_{12}$ signal processing device 122 further causes slidable retraction of tongue 46 such that primary arms 38 may rotate counter 30 clockwise without lifting spool 24.

If tongue 46 does not retract then signal processing device 122 monitors the position of secondary arms 56. When $\delta_X=\delta_B$ spool 24 is clear of the furthest possible extent of tongue 46 and signal processing device 122 activates the primary arm motor to return primary arms 38 to $\alpha_{12}$ position if it has not already been done, without regard to the position of tongue 46. When primary arms 38 reach the twelve o'clock position the turn-up sequence is complete. Tongue 46 may be extended once again awaiting commencement of the next turn-up cycle.

Various embodiments of the invention have now been described in detail. Since changes in and or additions to the above-described best mode may be made without departing from the nature, spirit or scope of the invention, the invention is not to be limited to those details, but only by the appended claims and their equivalents.

We claim:

1. Apparatus for sensing the presence of a web on a spool, said apparatus comprising:

a structural member mountable on a support structure for positioning the apparatus adjacent a spool, sensing means carried out by the structural member and operable to directly sense the presence or otherwise of a web on the spool, said sensing means having a first output state when a bare spool is directly sensed and a second output state when a web on the spool is directly sensed, and means for communicating the output state of the sensing means to a signal processing device.

2. Apparatus according to claim 1 wherein first and second followers are carried by the structural member for riding on the surface of a bare spool or on a web on the spool.

3. Apparatus according to claim 2 wherein the sensing means includes an electrical resistance measuring circuit with which the first and second followers are in electrical communication whereby the electrical resistance of the surface on which the followers ride can be measured to distinguish between a bare spool and a web on the spool.

4. Apparatus according to claim 2 wherein the sensing means has a sensing end between the first and second followers and positionable adjacent to the spool.

5. Apparatus according to claim 2 wherein the sensing means includes distance measuring means associated with one of the followers.

6. Apparatus according to claim 1 wherein the sensing means is selected from the group consisting of:

a) an electrical resistance measurement circuit:

b) a proximity sensor;

c) a photoelectric sensor: and d) a digital camera.

* * * * *